US005279448A

United States Patent [19]

Hanlin et al.

[11] Patent Number: 5,279,448

[45] Date of Patent: Jan. 18, 1994

[54] INSTALLABLE AND CENTRALIZED SELF-CONTAINED APPLIANCE-LIKE FLUID DISPENSING SYSTEM

[76] Inventors: Michael O. Hanlin, 1079 Baumock Burn Dr., Columbus, Ohio 43235; Eugene A. Zilber, 1287 City Park, Columbus, Ohio 43206

[21] Appl. No.: 839,545

[22] Filed: Feb. 18, 1992

[51] Int. Cl.[5] ..... B67D 5/60

[52] U.S. Cl. ..... 222/132; 222/136; 222/144.5; 222/145; 222/630; 239/310

[58] Field of Search ..... 222/4, 135, 136, 144.5, 222/145, 183, 325, 529, 630, 132; 239/310, 318, 526, 527, 549

[56] References Cited

U.S. PATENT DOCUMENTS 3,118,610 1/1964 Techler .
3,318,535 5/1967 New .
3,361,300 1/1968 Kaplan .
3,575,348 4/1971 MacKay .
3,595,268 7/1971 Archer .
3,608,824 9/1971 Ballou .
4,176,793 12/1979 Heinrich .
4,197,994 4/1980 Liedberg .
4,585,168 4/1986 Even et al. .
4,621,770 11/1986 Sayen .
4,850,536 7/1989 Teranishi et al. .
5,020,917 6/1991 Homan ..... 222/135 X
5,074,438 12/1991 Ingram ..... 222/630 X

*Primary Examiner*—Gregory L. Huson
*Attorney, Agent, or Firm*—Vorys, Sater, Seymour & Pease

[57] ABSTRACT

There is disclosed an installable and centralized self-contained, appliance-like fluid dispensing system for selectively dispensing combinations of fluids or fluid and liquid dispersants. The system includes a centralized housing assembly housing sources of liquid dispersant, pumping devices, valve arrangements, manually controlled system devices and arrangement for providing compressed air to a hand held device.

6 Claims, 6 Drawing Sheets

10
18a
26
24
22
66
68
30
58
73
70
TO PANEL
ELECTRIC SOURCE
17
35
FROM GUN SWITCH
70
SYSTEM
TO MOTOR
20
PANEL
21a
TO VALVES
TO COMP. AIR VALVE
31
33
42
FROM PANEL AND GUN
43
40c
38c
40b
38b
40a
38c
34a
34c
36
34b
12
FROM GUN
16a
14a
15a
HOT WATER
FROM PANEL
45
32
OUT
28
43
COMPRESSOR
PUMP & MOTOR
IN
48
COLD WATER
16b
14b
15b
45a
44
31a
COMPRESSED AIR
FROM PANEL
46
FROM CONTROL PANEL

INSTALLABLE AND CENTRALIZED SELF-CONTAINED APPLIANCE-LIKE FLUID DISPENSING SYSTEM

BACKGROUND OF THE INVENTION

The present invention relates generally to spraying and washing equipment and, more particularly, to a versatile, installable and centralized self-contained, fluid dispensing system which serves as an appliance-like device for use in a household and is selectively operable to dispense a variety of fluid mixtures through a fluid applicating device, such as a hand-held spray gun.

Heretofore, the prior art has offered various fluid dispensing systems which dispense, through a hand-held spray gun device, water and various detergents, concentrates, etc. The dispensing of such dispersants can be for such diverse purposes as automobile cleaning, lawn and garden care, snow and ice removal, etc. Therefore, it is desirable to have a versatile and durable washer system which operates to selectively apply different cleaning or treating substances to the objects to be cleaned or treated. In addition, it is desirable to minimize many laborious tasks involved in a cleaning operation. Often a significant amount of time and labor are expended in setting-up and disassembling the various components in known systems. Furthermore, it is desirable to provide a system which is constructed and arranged to perform many of the cleaning and treatment functions primarily in a residential environment in a much easier, faster and more convenient manner. To achieve these desires there are, for example, efforts in the marketplace to sell hose-end products. These are products which are directly attachable to, for example, a garden hose and can be used for cleaning and/or lawn and garden care functions. Such products include individual containers in which the substances to be dispensed are housed and which are separately attached to the hose end. In general this approach is limiting since the container must be changed for different treatments and only household water pressure is typically involved.

Besides hose-end products, provisions have been made for so-called power washing type systems. Several examples of such systems are described in U.S. Pat. Nos.: 3,118,610; 3,318,535; 3,361,300; 4,176,793; 4,197,994; 4,585,168; 3,575,348; 4,621,770; 3,595,268; 4,850,536; and 3,608,824. There are, however, significant shortcomings associated with these known power washer systems. These shortcomings include the fact that they comprise a number of separate components which are often not readily accessible and which nevertheless require time-consuming assembly procedures to be joined together into an assembly which can function. Also significantly, they are not entirely centralized and easily installable into, for example, a residential environment as an appliance-like device.

SUMMARY OF THE INVENTION

According to the present invention there is provided an improved self-contained fluid dispensing system which overcomes the aforenoted shortcomings of the prior art as well as provides for significant advantages thereover.

In this regard, there is provided a self-contained and centralized fluid dispensing system which is operable for selectively dispensing different combinations of fluids and dispersants and which is easily installable as an appliance-like device to residential water outlets and electrical outlets. Included in the system is a self-contained housing means centrally housing the components of the system. There is provided a relatively small and lightweight hand-held fluid applicating device which is operable for dispensing a variety of the fluid combinations. Operation selection control means are mounted on the hand-held device and are operable for generating remote mode selection signals for selecting different system functions. Also provided is a flexible hose for conveying pumped water or water and dispersant to a surface area to be treated by the fluids. Included in the housing means is a system electrical means electrically connected to the operation selection means on the fluid applicating device and is responsive to the mode selection signals for producing a plurality of system signals and is responsive to system selection means which are operable for controlling different system functions. Valve control means located in the housing means are provided which are responsive to the mode selection and system selection signals for opening and closing respective valves and thereby allowing communication between at least a dispersant source and a source of flowing water, by reason of a venturi effect, so as to withdraw dispersant into the flowing water. Pumping means located in the housing means is provided and is operable in response to the signals from the electrical system means to pump the dispersant and water or water to the fluid applicating device. Included in the housing means is fluid inlet means for coupling the pumping means to residential or commercial sources of water.

In another illustrated embodiment, there is provided a self-contained housing assembly comprising at least a compartment means including mounting means. The housing assembly includes at least a source of liquid dispersant including a container for holding the dispersant. The source container is mountable in the compartment on the mounting means. Pumping means operable for pumping water from the inlet means through a delivery line is located within the compartment means. Provision is made for means, mounted in the compartment on the mounting means and being fluidly connectable to the container and the delivery line and operable, for facilitating flow of the dispersant from the container by venturi effect when flowing water passes therethrough. Valve means in the compartment means is operable between inoperative and operative states, such that when in the operative state, the container and the venturi means are in fluid communication with each other for allowing discharge of the dispersant from the container to the delivery line. A flexible hose storable in the compartment means is provided for conveying the flowing water or water and dispersants to a hand-held fluid applicating device for dispensing. Provision is made for operation selection control means which is mounted on the hand-held device and is operable manually for generating remote control selection signals for controlling different system functions. Means located in the housing compartment is electrically connected to the selection control means on the hand-held device and is responsive to the selection signals for producing a plurality of system signals. The system means is also operable in response to system selection means having independent manual control switch means so as to select different modes of system operation. Also, included in the embodiment is means for providing compressed air to a different hand-held fluid applicating device, in response to signals generated from the system electrical means. The compressed air means is also housed in the housing assembly.

In another illustrated embodiment, there is provided a plurality of dispersant sources, each of them being independently coupled fluidly to the valve control means associated with the dispersants as well as the pumping assembly. In this manner at least a single source of dispersant can be introduced into and pumped with the water to the hand-held device.

Among the objects of the present invention are the provision for an installable and centralized self-contained appliance-like fluid dispensing system; the provision of an improved self-contained system of the foregoing type which includes an appliance-like housing assembly which houses all system components; the provision of a centralized self-contained fluid dispensing system which is easily installable as a unit to a household water system; the provision of an improved system of the foregoing type, which is selectively operable to dispense fluid or fluid with at least one of a plurality of dispersants from a hand held fluid applicating device; the provision of an improved self-contained system of the aforenoted type which includes an assembly having a source for providing compressed air to a different hand-held device which source of compressed air is in the housing assembly; the provision of an improved self-contained system which is easily installable as a unit to a household electrical system; the provision of an improved self-contained system of the last noted type which is inexpensive, and reliable to manufacture and operate; and, the provision of an improved self-contained system of the last noted type which is versatile insofar as it provides for numerous fluid applying functions.

These and other objects and further scope of applicability of the present invention will become apparent from the detailed description to follow when taken in conjunction with the accompanying drawings wherein like parts are designated by like reference numerals throughout the several views.

DETAILED DESCRIPTION

Reference is made to FIGS. 1–7*a* for purposes of illustrating one preferred embodiment of an installable and centralized self-contained appliance-like cleaning system 10 of the present invention.

Figure 1:
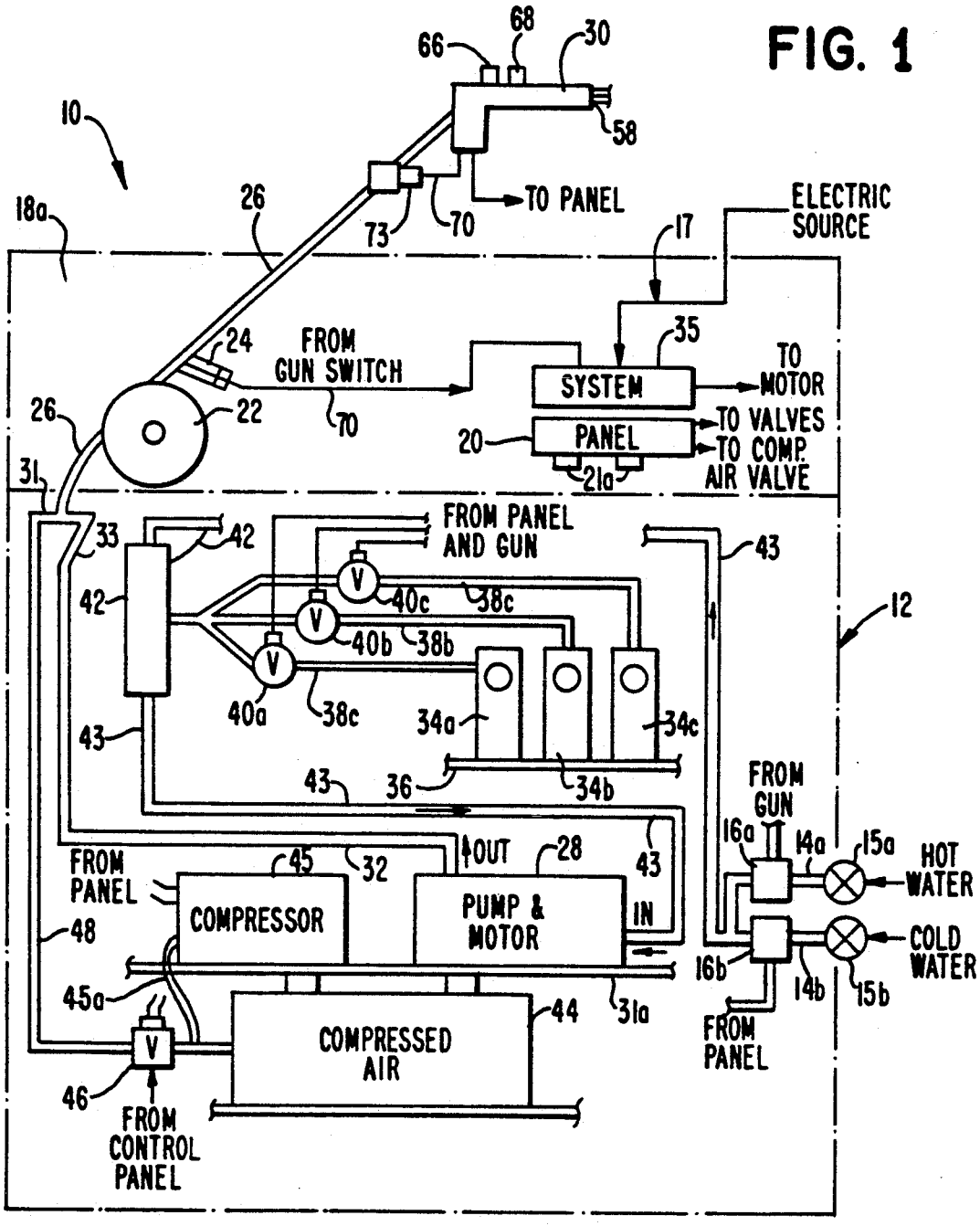
FIG. 1 is a diagrammatic view of one preferred system made in accordance with the principles of the present invention.
Figure 2:
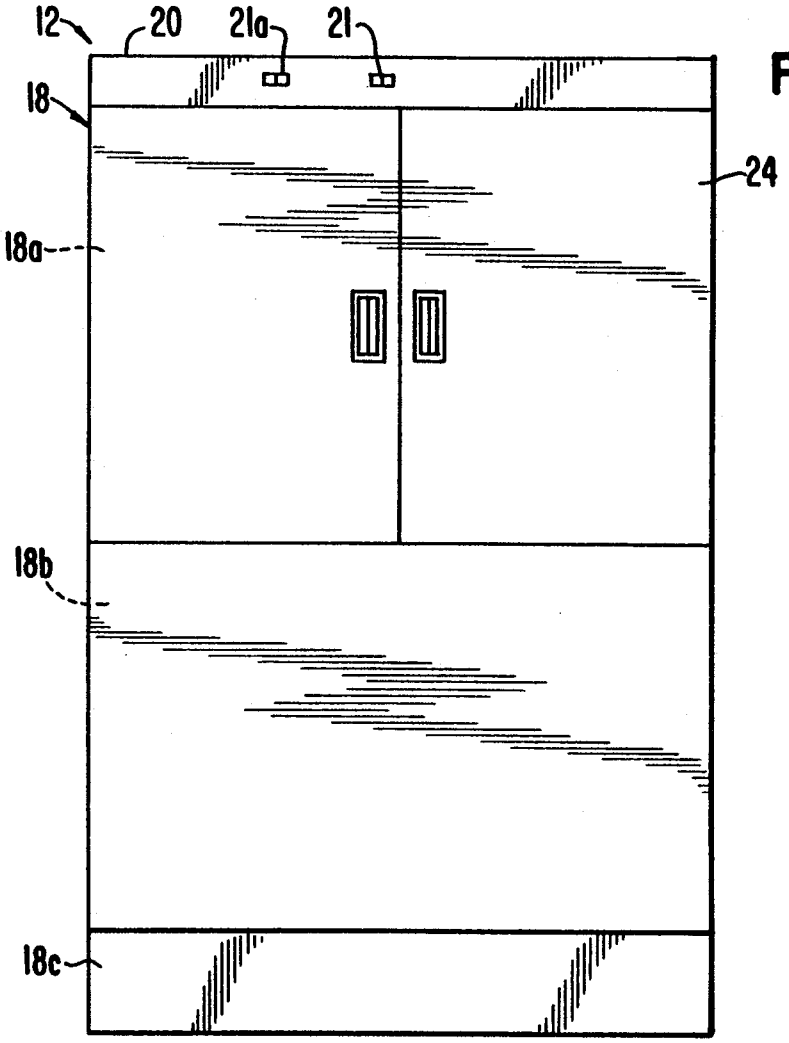
FIG. 2 is a elevational view depicting a housing component of the present system.
Figure 3:
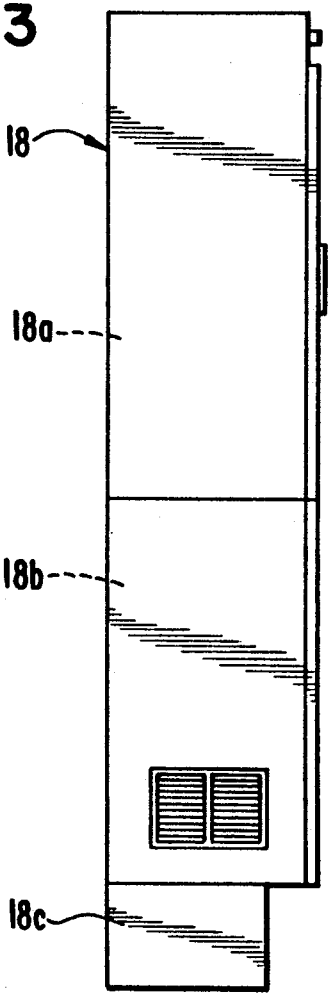
FIG. 3 is a side view of the housing assembly as depicted in FIG. 2.
Figure 4:
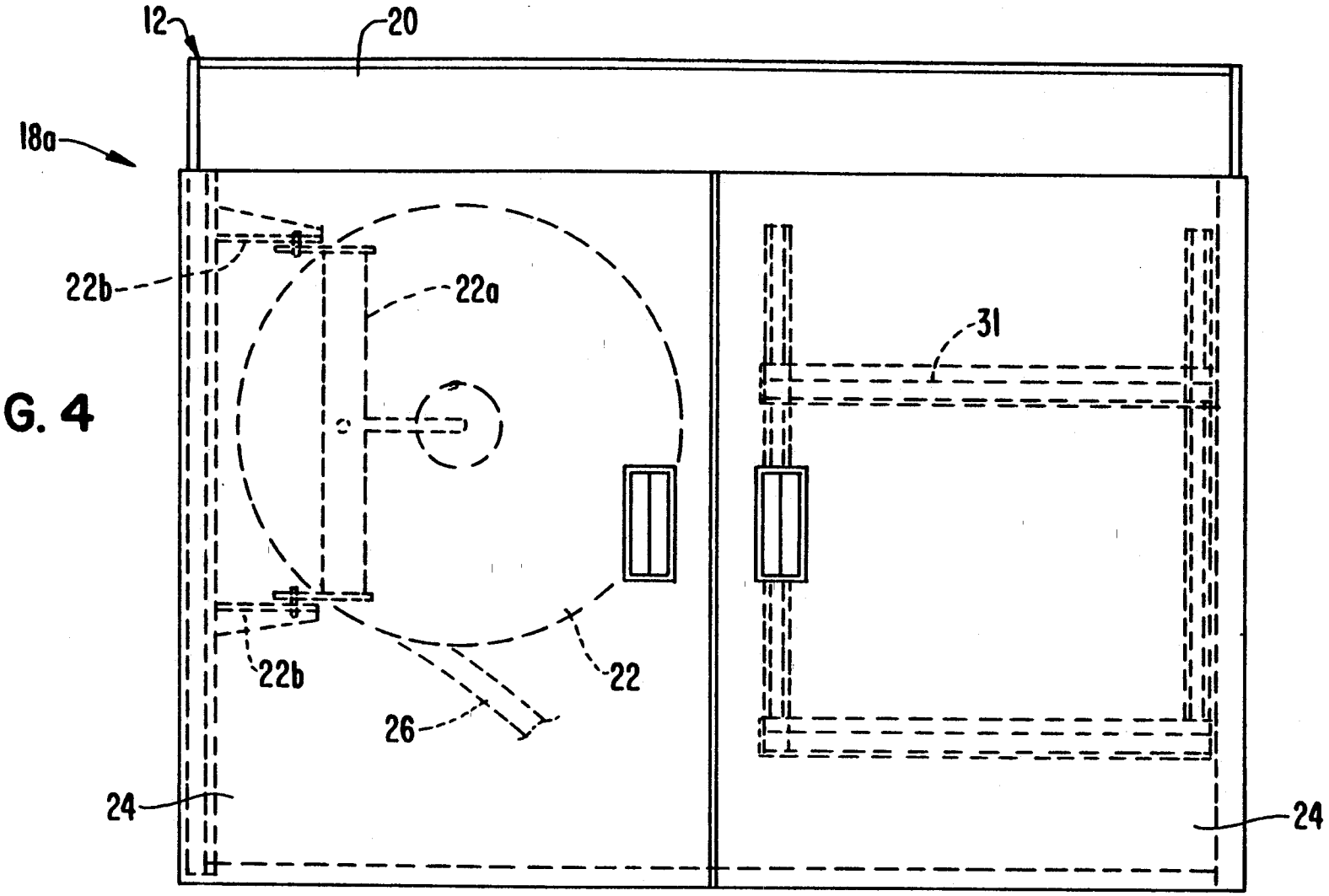
FIG. 4 is an enlarged view of an upper cabinet structure of the housing assembly.

As depicted in FIGS. 1–3, the self-contained, appliance-like system 10 includes an improved self-contained housing assembly 12 which is installable as an appliance-like unit in a household environment; such as a garage, basement, or the like. As will be appreciated, the housing assembly 12 stores, in a compact and centralized fashion, all the operating components of the system 10 including a plurality sources of dispersants which includes detergent, treating solutions and the like. The housing assembly 12 is directly attached to standard household fluid fittings such as a laundry connection and is plugged into a standard A.C. power source. As will become apparent from the detailed description to follow, the selective dispensing of various mixtures of liquids for such diverse purposes as automobile cleaning, lawn and garden care, snow and ice removal can be accomplished in an easier, faster and more convenient manner than heretofore known.

The self-contained system 10 includes, in the housing assembly 12, fluid inlet means including fluid inlets 14*a*, 14*b* directly couplable by fluid fittings to household hot and cold water outlets 15*a* and 15*b*; respectively. The outlets 15*a* and 15*b* supply hot and/or cold water through inlet valves 16*a* and 16*b*, respectively, connected to the fluid system in the housing assembly 12. In this system, the cold water is always run, therefore, the valve 16*b* is operated to be open and is under control of a selector switch to be described on a selector control panel. As will be explained spray-gun control switch. The water pressure supplied is in the standard range for household and/or commercial applications. The electrical power to operate the system 10 is derived from a conventional AC source and is connected by an appropriate electric cable 17 to the system. As such, no special adaptions to household fluid and electrical systems are required when using the invention. This greatly enhances the versatility of the invention since it can be quickly and easily hooked-up to most residential and commercial establishments.

Figure 6:
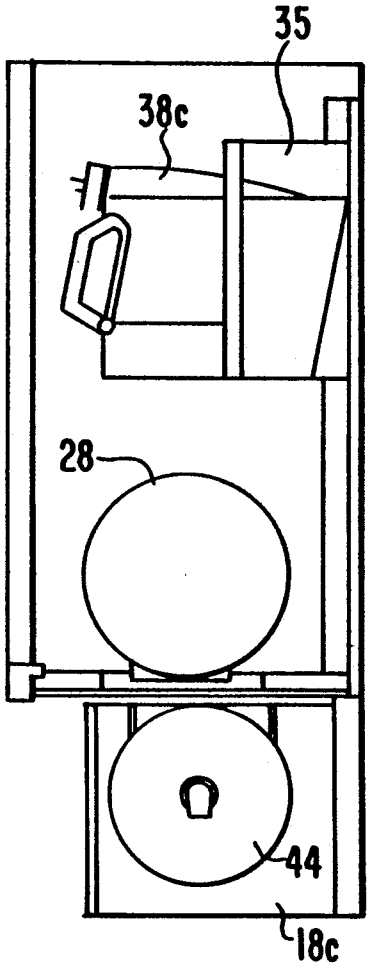
FIG. 6 is a side view of FIG. 5.

With continued references to FIGS. 1–4, it is seen that the housing assembly 12 includes an upstanding cabinet 18 having upper and lower compartments or cabinets 18*a*, 18*b*; respectively. In one embodiment, the upper cabinet 18*a* includes a system selector control panel 20 that includes manual selector control switches 21, 21*a*, mounted on the exterior of the cabinet. The selector switch 21 is a three position switch, which includes an "off" position, a "water" position, and a "compressed air" position. The selector switch 21*a* is a switch which is operable between a concentrate "off" position, and several concentrate "on" positions corresponding to separate valves in communication with sources of concentrates as will be described. The upper cabinet 18*a* is arranged to conveniently store a reel assembly 22. The reel assembly 22 can have several configurations. In this embodiment, the reel assembly 22 is mounted on a swivel assembly 22*a* to bracket structure 22*b* in the upper cabinet 18*a*. A pair of doors 24 are suitably latched to the cabinet 18. Wrapped on the reel assembly 22 is a flexible, high pressure hose 26 that is to be used for the various functions intended by the invention. One end of the hose 26 is fluidly downstream, at the high pressure end, of a fluid pump 28 (FIGS. 1 and 6). In the lower compartment 18*b*, the pump 28 is operable to additionally pressurize the water, for example to 1000 psi, from the normal pressure of the household water. The other end of the delivery hose 26 is coupled to a spray gun device 30 that is manually controlled, as will be described, to control dispensing of various combinations of water and dispersants. When not in use the spray gun 30 is also storable in the upper cabinet 18*a* on shelf 31 or other similar structure. A fluid tee-coupling 33 (FIG. 1) connects the inlet end of the hose 26 to a pressure delivery line 32. The tee-coupling 33 also fluidly connects the compressed air line to the hose 26 in a manner which will be described. A suitable motor associated with the pump 28 is operated by an electrical circuit system device 35 which is under manual control of a spray gun switch for selectively actuating the pump 28. The pump 28 is operable to deliver high-pressure fluid (e.g. 1000 psi) to the spray-gun 30 and in the process, as will be described, draw dispersant, by virtue of the venturi effect, from suitable ones of the containers that are in fluid communication with the low pressure side of the pump.

Figure 5:
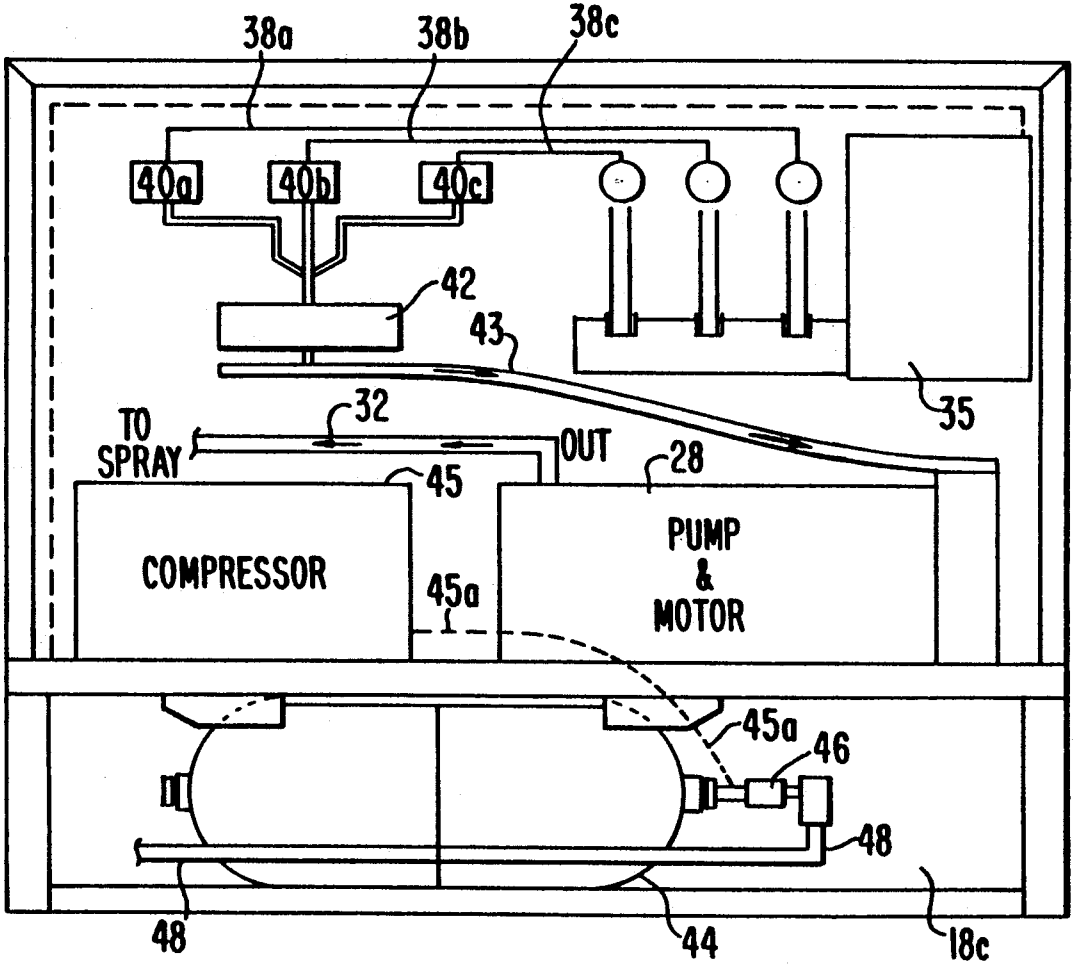
FIG. 5 is an enlarged view of a lower cabinet structure of the housing assembly.

As depicted in FIGS. 1, 5 and 6, it is seen as including a plurality of capped containers 34*a,b,c,* each of which can contain a different type of fluid dispersant for purposes of achieving a variety of household and/or commercial cleaning or treating functions, etc. The containers 34*a,b,c* are storable on a shelf 36. The fluid contents of the containers can include detergent for washing cars, lawn treating chemicals; and ice and snow removal solvents.

Supply lines 38*a,b,c* travel from each container 34*a,b,c* respectively through corresponding solenoid valves 40*a,b,c* operated from the selection switch 21*a* on the control panel 20. The switch 21*a* selects which valve 40*a–c* is to be operated by a switch on the spray gun so as to be connected to venturi injector 42. The valves 40*a, b, c* are shown separately, but can be located in a single manifold type housing which serves to connect the three supply lines 38*a, b, c* to a single outlet thereof which is in communication with the venturi injector 42. Opening of a single valve 40*a,b,c* is controlled by the panel switch 21*a* and gun switch. When a valve 40*a, b, c* is open, it allows the contents of a corresponding one of the containers to be dispensed by operation of the venturi device 42 which is connected to the low pressure side of the pump. When water flows through the venturi injector device 42 via line 43 suction is created which is sufficient to withdraw the fluid contents from the selected container; provided a corresponding one of the control valves 40*a,b,c* is open. Specifically, the device 42 is connected to the low pressure side of the pump by the line 43 coming from the valves 16*a,* 16*b.* From the pump 28 the pumped fluid travels via line 32 coming from the tee-connector 33 and then from the inlet end of the hose 26.

The present invention has added versatility because in addition to the cleaning functions, it also provides compressed air at a separate fluid applicating attachment (not shown) which is known. The compressed air can be used for a variety of cleaning functions and inflation functions as well. A compressed air tank 44 is stored in a compartment 18*c* and mounted by brackets to thereto beneath the pump and compressor combination. A compressor 45 is fluidly connected by a known fluid connection line arrangement 45*a* extending therefrom to a location between the compressed air tank 44 and a solenoid valve 46. Operation of the compressed air function by switch 21 on the panel 20 through the electric system 35 is effective to activate both the compressor 45 and open the solenoid valve 46 whereby the air tank and compressor operate in a known manner. The solenoid valve 46 is connected to a compressed air line 48 and, as noted, is under control from the selector switch 21 at the control panel 20 through the electric system 35. The solenoid valve 46 is operable to open and close flow of the compressed air to the attachment through the hose 26. The other end of the compressed air line 48 is connected to the tee-connector 33 and will then supply compressed air to the hose 26 and then to the attachment; when the water and detergent are not being pumped.

Figure 7:
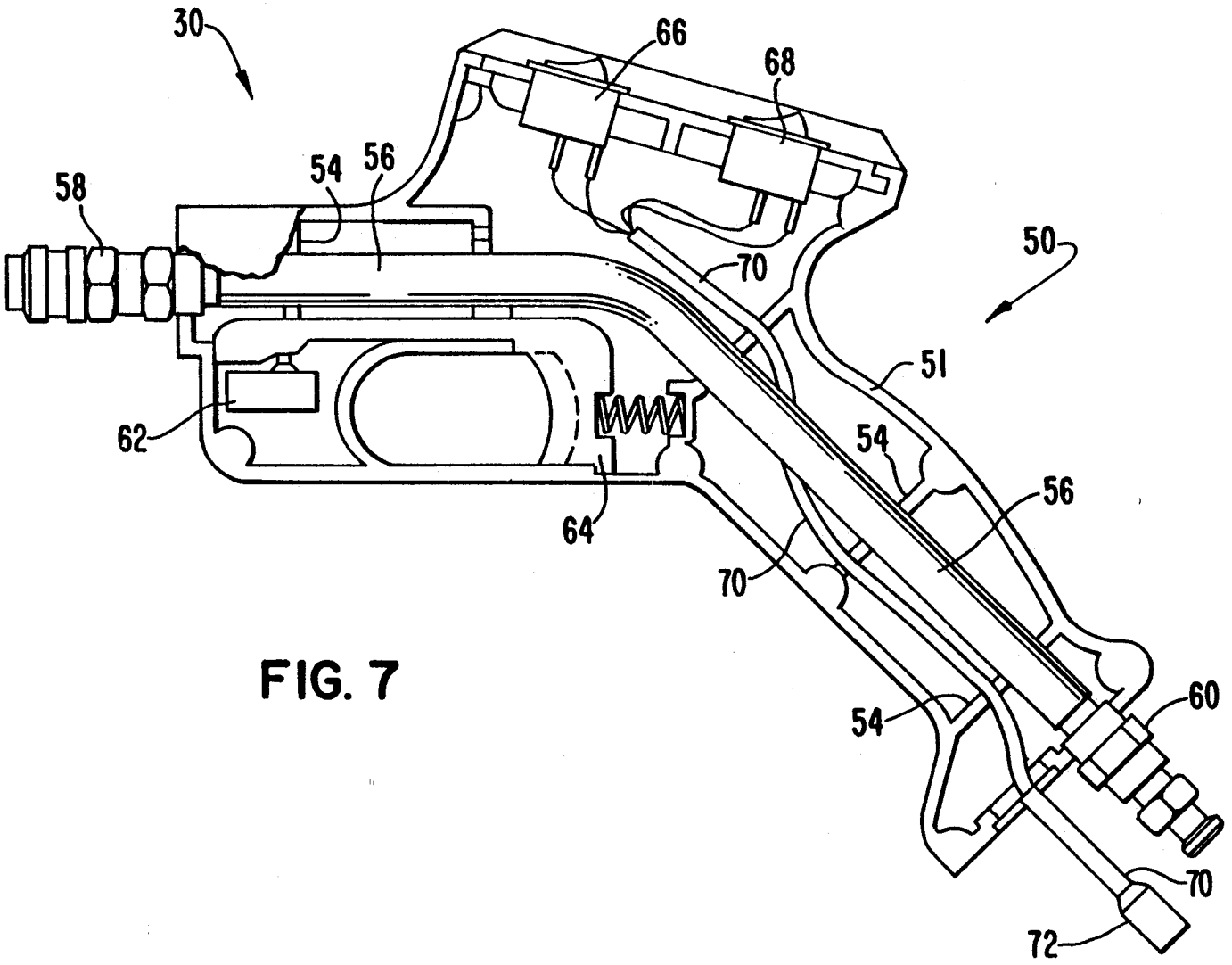
FIG. 7 is a view of a spray gun of the present system.
Figure 7A:
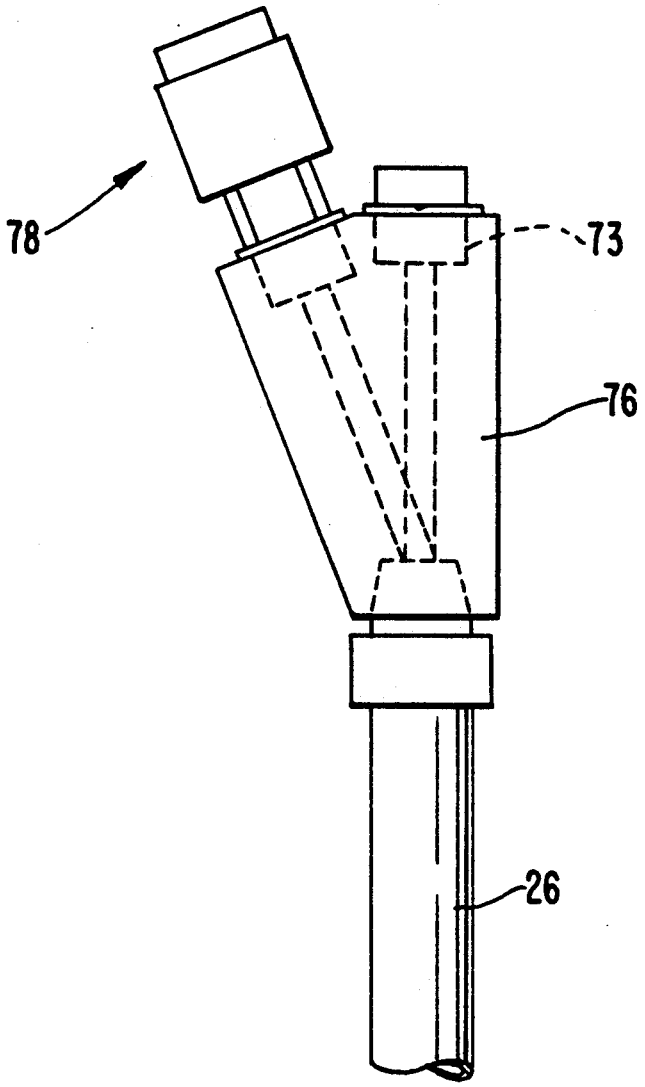
FIG. 7*a* is a schematic view of a quick disconnect arrangement.

Reference is now made to FIGS. 1, 7 and 7*a* for illustrating the spray gun 30 for use in the present embodiment. As depicted, the spray gun 30 includes a housing assembly 50 having a housing component 51 shaped like a pistol and a correspondingly shaped portion joined thereto. As best seen in FIG. 7, the housing component 51 includes internal ribs 54 which removably secure therein an internal tubing 56. A spray nozzle 58 is attached to one end of the tubing 56 and the other tubing end is attached to a fluid fitting 60 and is ultimately coupled to the hose 26. A trigger activated switch 62 will be actuated by a spring-biased trigger mechanism 64 in known fashion so as to start the water pump.

It will be appreciated that several spray gun embodiments are contemplated for use in this invention. A pair of manually operated selection control switches 66 and 68 are mounted in the top of the housing assembly 50. The switches 66 and 68 are connected to an insulated electric cable 70 which extends from the spray gun housing component 51 attached through a quick disconnect 72 which in turn is connected to an electrical quick connect 73 of a fitting 76 (FIG. 7*a*) that allows the electric cable to go to the system 35. Accordingly, the cable 70 extends through the pressurized fluid in the hose 26. Another fitting 74 (FIG. 1) similar to quick connect 73 is adjacent the inlet end of the hose 26 and allows for the cable 70 to extend to the electrical system device 35. Of course a variety of fittings connecting the cable 70 to and through the hose can be used. Although not shown the electrical system 35 includes a step down transformer to lower to 12 volts the voltage in the cable 70. The fitting 76 has a hydraulic quick connect 78 to the gun which is also coupled with the hose 26.

In the illustrated embodiment, the switch 66 is an on/off type switch operable for actuating introduction of the dispersants. The signal generated by the switch 66 operates to open the normally closed solenoid valve 40*a, b, c* which was selected by a selector switch 21*a* on the panel 20. The switch 68 is an on/off type for adding hot water to the cold water line and when operated issues a selection signal through electrical system device 35 which controls the valve 16*a* associated with the hot water. The type of concentrate dispensed from the containers will vary as a function of the type that is selected at the control panel 20 by the appropriate selection switch 21*a* to selectively actuate individual ones of the valves 40*a, b, c* which can be actuated by switch 66. In other words, the selector switch on the cabinet selects the container which is to be used and the switch 66 controls whether the concentrate will be dispensed. More specifically, the selector switch 21*a* controls which solenoid valve 40*a, b, c* will be opened to be in communication with operation the switch 66 to deliver the concentrate.

After having described one preferred embodiment of the present invention, it will be appreciated that several others are contemplated as well. In addition based upon the foregoing, the operation of the system is self-evident. The foregoing fluid handling circuit is but one of many circuits for controlling different functions. Significantly, the present invention provides an appliance-like centralized fluid system that is directly installable as a unit to conventional household and commercial water and electrical fixtures.

Since certain changes maybe made in the above described system without departing from the scope of the invention involved, it is intended that all matter contained in the description thereof or shown in the accompanying drawings shall be interpreted as illustrative and not in a limiting sense.

What is claimed is:

1. An installable and centralized, self-contained fluid dispensing appliance type system operable for selectively dispensing combinations of fluid or fluid and liquid dispersants, said system comprising:

a self-contained and centralized housing assembly usable in a residential or commercial environment and including at least a storing compartment means and having mounting means in said compartment means;

inlet means in said storing compartment for coupling of said system to a source of water;

at least a source of liquid dispersant including a container for holding the dispersant, said container being mountable in said storing compartment on said mounting means;

pumping means in said storing compartment and operable for pumping water from said inlet means through a pumped fluid delivery line;

means in said storing compartment on said mounting means and being fluidly connectable to said container and said delivery line and operable for facilitating flow of the dispersant from said container by venturi effect when water is passing therethrough;

valve means in said storing compartment and operable between inoperative and operative states such that when in said operative state said container and said venturi means are in fluid communication with each other for allowing discharge of the dispersant from said container;

a flexible hose for conveying the water and dispersant, said hose being storable in said storing compartment;

a relatively small lightweight hand-held fluid applicating device for applying fluid storable in said storing compartment;

operation selecting means mounted on said hand-held device and being operable manually for generating remote control selection signals; and, system means in said storing compartment means being electrically connected to said selection means and being responsive to the selection signals of said selecting means for producing a plurality of system signals and also being operable in response to operation of at least an independent manual control switch means thereof so as to control operations of said fluid system including said pumping means and said venturi effect means to disperse a desired combination of fluids or fluid and liquid dispersants.

2. The system of claim 1 further including:

means operable for providing compressed air to a hand-held device fluid applying through said hose in response to signals from said switch means, said compressed air means including a compressor and a compressed air tank being housed in said compartment means.

3. The system of claim 1, wherein said selection means includes insulated electric cable means for conveying the selection signals to said system means, wherein said cable means passes lengthwise through at least a portion of said hose.

4. The system of claim 3 further including a plurality of sources of dispersants stored in said compartment, each of said sources being independently communicable fluidly to individual solenoid valves, said solenoid valves being connected with said venturi means.

5. The system of claim 1 wherein said compartment means includes first and second section means, said first section means housing said hose, said spraying device and said control means, and said second section means housing said pumping means and said source means.

6. An installable and centralized self-contained fluid dispensing appliance type system operable for selectively dispensing combinations of fluid and/or fluid and liquid dispersants, said system comprising:

a self-contained and centralized housing assembly usable in a residential or commercial environment and including at least a compartment means and having mounting means in said compartment means;

inlet means in said compartment means for coupling said system to a residential source of water;

at least a source of liquid dispersant including a container for holding the dispersant, said container being mountable in said compartment means on said mounting means;

pumping means in said compartment means and operable for pumping water from said inlet means through a pumped fluid delivery line;

means mounted in said compartment on said mounting means and being fluidly connectable to said container and said delivery line and operable for facilitating flow of the dispersant from said container by venturi effect when water is passing therethrough;

a relatively small lightweight hand-held spraying device for spraying the water or water and dispersant;

a flexible hose for conveying the water and dispersant under pressure to said spraying device, said flexible hose being storable in said compartment means;

operation selecting means mounted on said hand-held device and being operable manually for generating remote control selection signals;

electrical system means in said housing compartment means and electrically connected to said operation selecting means and being responsive to the selection signals for producing a plurality of system signals and also being operable in response to independent manual control switch means thereof so as to control operation of said fluid system; and, means operable for providing compressed air to a separate hand-held device through said hose in response to signals from said switch means, said compressed air means including a compressor and compressed air tank being housed in said compartment means.

* * * * *